US010826236B2

(12) United States Patent
Kohen

(10) Patent No.: US 10,826,236 B2
(45) Date of Patent: Nov. 3, 2020

(54) DISCONNECTING AND SUPPORTING QUICK RELEASE ELECTRICAL FIXTURES

(71) Applicant: Ran Roland Kohen, Aventura, FL (US)

(72) Inventor: Ran Roland Kohen, Aventura, FL (US)

( * ) Notice: Subject to any disclaimer, the term of this patent is extended or adjusted under 35 U.S.C. 154(b) by 0 days.

(21) Appl. No.: 16/605,994

(22) PCT Filed: Apr. 17, 2018

(86) PCT No.: PCT/US2018/027956
§ 371 (c)(1),
(2) Date: Oct. 17, 2019

(87) PCT Pub. No.: WO2018/195068
PCT Pub. Date: Oct. 25, 2018

(65) Prior Publication Data

US 2020/0144766 A1 May 7, 2020

Related U.S. Application Data

(60) Provisional application No. 62/486,132, filed on Apr. 17, 2017.

(51) Int. Cl.
*H01R 13/627* (2006.01)
*H01R 24/66* (2011.01)
*H01R 24/76* (2011.01)

(52) U.S. Cl.
CPC ..... *H01R 13/6276* (2013.01); *H01R 24/66* (2013.01); *H01R 24/76* (2013.01)

(58) Field of Classification Search
CPC ..... H01R 13/6272; H01R 4/01
(Continued)

(56) References Cited

U.S. PATENT DOCUMENTS 484,911 A 10/1892 Green
1,595,972 A 8/1926 DeReamer
(Continued)

FOREIGN PATENT DOCUMENTS

CN 1728475 A 2/2006
CN ZL 01 8 23877.7 11/2007
(Continued)

OTHER PUBLICATIONS

Response filed Jan. 17, 2019, in U.S. Appl. No. 15/573,606.
(Continued)

*Primary Examiner* — Phuong Chi Thi Nguyen
(74) *Attorney, Agent, or Firm* — Paul D. Bianco; Gary S. Winer; Fleit Intellectual Property Law

(57) ABSTRACT

A plug is connectable to an electrical socket which has concentric ring shaped openings housing electrical contacts. The plug has a body supporting electrically conductive concentric rings insertable into the socket to contact the electrical contacts to form electrical connections. A hollow post extends away from the plug body and has a transverse aperture therethrough. A rod with a narrowed portion is slideable within the post. A spring biases the rod towards a latched position in which the narrow portion is not adjacent to the transverse aperture. A cross-brace is connected to a portion of the rod which extends outside of the post. Pins engage the cross brace and can be pushed to move the brace, and thereby push the rod to position the narrowed portion to an unlatched position adjacent the aperture to enable removal of the plug.

11 Claims, 5 Drawing Sheets

(58) Field of Classification Search
USPC ..... 439/352, 161, 353, 357, 675, 851
See application file for complete search history.

(56) References Cited

U.S. PATENT DOCUMENTS 1,897,954 A 2/1933 D'Olier
2,077,587 A 4/1937 Rowe
2,308,016 A 1/1943 Mihalyi
2,313,481 A 3/1943 Rendano
2,494,428 A 1/1950 Buck
2,673,966 A 3/1954 Larkin
2,726,372 A 12/1955 Appleton
2,728,895 A 12/1955 Quackenbush
2,863,037 A 12/1958 Johnstone
3,118,713 A 1/1964 Ellis
3,159,444 A 12/1964 Stine
3,193,636 A 7/1965 Daniels
3,386,071 A 5/1968 Allen
3,398,260 A 8/1968 Martens
3,521,216 A 7/1970 Tolegian
3,585,564 A 6/1971 Skjervoll
3,648,002 A 3/1972 Du Rocher
3,651,443 A 3/1972 Quilez
3,668,603 A 6/1972 Burgess et al.
3,798,584 A 3/1974 Person
3,808,577 A 4/1974 Mathauser
3,813,478 A 5/1974 Ervin
3,855,564 A 12/1974 Dumas
3,871,732 A 3/1975 Appleton
4,059,327 A 11/1977 Vann
4,079,244 A 3/1978 Bortoluzzi
4,083,619 A 4/1978 McCormick et al.
4,107,770 A 8/1978 Weber
4,133,594 A 1/1979 Laverick et al.
4,335,927 A 6/1982 Allen
4,448,388 A 5/1984 Dennis
4,462,653 A 7/1984 Flederbach
4,473,869 A 9/1984 De Widt
4,588,248 A 5/1986 Moore
4,631,648 A 12/1986 Nilssen
4,681,385 A 7/1987 Kruger et al.
4,753,600 A 6/1988 Williams
5,003,128 A 3/1991 Grondin
5,034,869 A 7/1991 Choi
5,173,053 A 12/1992 Swanson et al.
5,250,874 A 10/1993 Hall et al.
5,352,122 A 10/1994 Speyer
5,362,122 A 11/1994 Reihl et al.
5,438,216 A 8/1995 Juskey et al.
5,442,532 A 8/1995 Boulos et al.
5,494,325 A 2/1996 Liu et al.
5,494,326 A 2/1996 Hinds
5,536,685 A 7/1996 Burward-Hoy
5,551,882 A 9/1996 Whiteman
5,562,458 A 10/1996 Stora et al.
5,584,726 A 12/1996 Le Gallic et al.
5,600,537 A 2/1997 Gordin
5,622,873 A 4/1997 Kim et al.
5,668,920 A 9/1997 Pelonis
5,710,541 A 1/1998 Stanley
5,754,408 A 5/1998 Derouiche
5,777,391 A 7/1998 Nakamura et al.
5,790,381 A 8/1998 Derouiche et al.
5,808,556 A 9/1998 Nelson
5,836,781 A 11/1998 Hyzin
5,952,714 A 9/1999 Sano et al.
5,962,810 A 10/1999 Glenn
6,068,490 A 5/2000 Salzberg
6,093,029 A 7/2000 Kwon et al.
6,129,598 A 10/2000 Yu et al.
6,135,800 A 10/2000 Majors
6,170,967 B1 1/2001 Usher et al.
6,175,159 B1 1/2001 Sasaki
6,240,247 B1 5/2001 Reiker
6,241,559 B1 6/2001 Taylor
6,332,794 B1 12/2001 Tzeng Jeng
6,340,790 B1 1/2002 Gordin et al.
6,364,716 B1 4/2002 Seo
6,366,733 B1 4/2002 Reiker
6,398,392 B2 6/2002 Gordin et al.
6,422,722 B1 7/2002 Voltolina
6,517,223 B2 2/2003 Hsu
6,595,782 B1 7/2003 Hsiao
6,598,990 B2 7/2003 Li
6,631,243 B2 10/2003 Reiker
6,648,488 B1 11/2003 Pearce
6,751,406 B2 6/2004 Reiker
6,793,383 B2 9/2004 Wu
6,821,089 B2 11/2004 Bilskie
6,837,754 B1 1/2005 Walton
6,962,498 B2 11/2005 Kohen
7,001,199 B1 2/2006 Badalpour
7,052,301 B2 5/2006 Garcia et al.
7,066,739 B2 * 6/2006 McLeish ..... H01R 13/6205 439/39
7,192,303 B2 3/2007 Kohen
7,462,066 B2 12/2008 Kohen
7,467,881 B2 12/2008 McMillen
7,706,757 B2 4/2010 Luglio et al.
8,123,378 B1 2/2012 Ruberg et al.
8,348,678 B2 * 1/2013 Hardisty ..... H01R 13/6205 439/39
8,354,768 B2 * 1/2013 Cipriani ..... H02K 21/24 310/209
8,357,016 B2 1/2013 Schumacher
D693,765 S * 11/2013 Workman ..... D13/110
8,702,435 B2 4/2014 Tajima
8,894,247 B2 11/2014 Kim et al.
8,979,347 B2 3/2015 Holman
9,901,039 B1 2/2018 Dellerson et al.
9,903,576 B2 2/2018 Creasman et al.
10,317,015 B2 6/2019 Joye
10,326,247 B2 6/2019 Kohen
2002/0060369 A1 5/2002 Akram
2002/0064380 A1 5/2002 Reiker
2002/0081107 A1 6/2002 Reiker
2003/0012027 A1 1/2003 Hsu
2003/0107891 A1 6/2003 Kohen
2004/0192415 A1 9/2004 Luglio et al.
2005/0148241 A1 7/2005 Kohen
2006/0141842 A1 6/2006 Sauer
2006/0146527 A1 7/2006 Vanderschuit
2007/0105414 A1 5/2007 Kohen
2007/0167072 A1 7/2007 Kohen
2008/0146064 A1 6/2008 Bankstahl
2009/0035970 A1 2/2009 Kohen
2009/0111322 A1 4/2009 Roland
2009/0129974 A1 5/2009 McEllen
2009/0280673 A1 11/2009 Kohen
2010/0020550 A1 1/2010 Kawashima
2010/0301769 A1 12/2010 Chemel et al.
2012/0196471 A1 8/2012 Guo
2013/0040471 A1 2/2013 Gervais et al.
2013/0107536 A1 5/2013 Hiraoka
2014/0168944 A1 6/2014 Osada et al.
2014/0225731 A1 8/2014 Gouveia
2014/0263903 A1 9/2014 Ostrobrod
2014/0268790 A1 9/2014 Chobot et al.
2015/0009666 A1 1/2015 Keng et al.
2015/0009676 A1 1/2015 Danesh
2015/0044040 A1 2/2015 Oda et al.
2015/0085500 A1 3/2015 Cooper
2016/0069556 A1 3/2016 Li
2016/0123374 A1 5/2016 Roberts
2017/0105265 A1 4/2017 Sadwick
2017/0234319 A1 8/2017 Seccareccia
2017/0248148 A1 8/2017 Kohen
2018/0115131 A1 4/2018 Kohen

(56) References Cited

U.S. PATENT DOCUMENTS

| | | | |
|---|---|---|---|
| 2019/0312396 | A1 | 10/2019 | Kohen |
| 2020/0018469 | A1 | 1/2020 | Kohen |

FOREIGN PATENT DOCUMENTS

| | | | |
|---|---|---|---|
| CN | 101095268 | A | 12/2007 |
| CN | 102870307 | A | 1/2013 |
| CN | 104033399 | A | 9/2014 |
| DE | 19849101 | A1 | 4/1999 |
| DE | 29923352 | U1 | 8/2000 |
| DE | 20203467 | U1 | 6/2002 |
| EP | 1024559 | A2 | 8/2000 |
| EP | 1456914 | A1 | 9/2004 |
| EP | 1789984 | A2 | 5/2007 |
| IL | 126246 | | 8/2001 |
| RU | 2011122686 | | 10/2012 |
| RU | 2526853 | | 8/2014 |
| WO | 00/16442 | | 3/2000 |
| WO | 01/01047 | A1 | 1/2001 |
| WO | 03/044906 | A1 | 5/2003 |
| WO | 2005053100 | A2 | 6/2005 |
| WO | 2005/074087 | A1 | 8/2005 |
| WO | 2006031853 | A2 | 3/2006 |
| WO | 2006/060772 | A2 | 6/2006 |
| WO | 2006060772 | A2 | 6/2006 |
| WO | 2011/020231 | A1 | 2/2011 |
| WO | 2011/134709 | A2 | 3/2011 |
| WO | 2011/134709 | A2 | 11/2011 |
| WO | 2012/167320 | A1 | 12/2012 |
| WO | 2016054159 | A1 | 4/2016 |
| WO | 2016/144795 | A1 | 9/2016 |
| WO | 2016/183354 | | 11/2016 |
| WO | 2016183354 | A1 | 11/2016 |
| WO | 2018/165646 | | 9/2018 |
| WO | 2018/165058 | | 10/2018 |
| WO | 2018/195068 | | 10/2018 |

OTHER PUBLICATIONS

European Search Report for Application No. 16793548.5 dated Feb. 14, 2019.
Second Office Action for Chinese Patent Application No. 201580063483.2, dated Jun. 14, 2019 (with translation of cover page).
International Search Report with Written Opinion dated Jul. 6, 2018 for PCT/US2018/027956.
Office Action dated Sep. 18, 2018 in U.S. Appl. No. 15/573,606.
International Search Report with Written Opinion dated Aug. 13, 2018 for PCT/US2018/030372.
Office Action dated Sep. 25, 2018 from Chinese Patent Office for Application No. 201580063483.2.
International Search Report for PCT/IL99/00499 filed Sep. 14, 1999.
European Search Report for EP 01 27 4757 dated Mar. 28, 2006.
Australian Examiner's First Report on Patent Application AU 2002221000.
Indian First Examination Report dated Jun. 24, 2010 for Indian Application No. 1677/KOLNP/2006.
New Zealand Examination Report for NZ Patent Application No. 533697 dated May 9, 2007.
For Chinese Patent Application No. 01823877.7: Notice of Allowance dated Oct. 17, 2006 Second Office Action dated Apr. 6, 2007 First Office Action dated Jul. 4, 2006.
For Russian Patent Application 2017142137 (national stage of PCT/US2016/032170): Prosecution history including decision to grant dated Oct. 25, 2019.
Office Action issued by the European Patent Office dated Dec. 19, 2019 for Application No. 16 793 548.5-1201.
International Search Report and Written Opinion for PCT/US2018/21919 filed Mar. 12, 2018 (047).
International Search Report and Written Opinion for PCT/US2018/20987 filed Mar. 5, 2018.
European Search Report dated Jul. 3, 2018 for Application No. 15846948.6.
International Search Report dated Jul. 18, 2016 for International Application No. PCT/US2016/032170 filed May 12, 2016.
Written Opinion for for International Application No. PCT/US2016/032170 filed May 12, 2016.
Chinese Search Report dated Feb. 18, 2019 for Patent Application No. 2016800404661.
First Office Action dated Feb. 27, 2019 from Chinese Patent Office for Patent Application No. 201680040466.1.
Final Office Action for U.S. Appl. No. 15/515,664, dated Mar. 10, 2020.
Office Action for U.S. Appl. No. 16/443,207, dated Mar. 11, 2020.
Publication issued in the Official Gazette from Mexican Patent Application MX/a/2017/004137 dated Feb. 13, 2018, 3 pages.
English translation of Search Report from Chinese Patent Office for Application No. 201580063483.2 dated Sep. 11, 2018.
Office Action from Chinese Patent Office for Application No. 201580063483.2 dated Sep. 25, 2018 (with English translation).
International Preliminary Report on Patentability dated Nov. 5, 2019 for International Application No. PCT/US2018/030372 filed May 1, 2018, 6 pages.
Written Opinion for International Application No. PCT/US2018/030372 filed May 1, 2018, 5 pages.
For Chinese Patent Application No. 201580063483.2 (national stage of PCT/US2015/053138): Third Office Action, dated Sep. 18, 2019 (with English translation) Response to Third Office Action, dated Dec. 2, 2019 (13 pages).
For Chinese Patent Application No. 201580063483.2 (national stage of PCT/US2015/053138): Response to First Office Action, dated Feb. 11, 2019 (9 pages) Response to Second Office Action, dated Aug. 26, 2019 (12 pages).
For Russian Patent Application No. 2016800404661 (national stage of PCT/US2016/032170): Second Office Action, dated Dec. 2, 2019 (3 pags) Search Report, dated Nov. 24, 2019 (2 pages ).
For Indian Patent Application No. 201717013438 (National Stage of PCT/US2015/053138): First Examination Report, dated Dec. 13, 2019 (6 pages).
IAEI, When continuity snaps, May-Jun. 2015.
IAEI, Supports reinforce our safety, Flanging Support Systems, Mar.-Apr. 2015.
International Preliminary Report on Patentability dated Nov. 14, 2017 for International Application No. PCT/US2016/032170 filed May 12, 2016.
Office Action for U.S. Appl. No. 15/515,664, dated Sep. 10, 2019.
International Preliminary Report on Patentability dated Sep. 10, 2019 for PCT/US2018/020987, filed Mar. 5, 2018.
International Search Report dated Jul. 6, 2018 for PCT/US2018/027956 filed Apr. 17, 2018.
Written Opinion Jul. 6, 2018 for PCT/US2018/027956 filed Apr. 17, 2018.
International Search Report dated May 17, 2018 for PCT/US2018/021919 filed Mar. 12, 2018.
Written Opinion for PCT/US2018/021919 filed Mar. 12, 2018.
International Preliminary Report on Patentability dated Sep. 10, 2019 for PCT/US2018/021919.
International Search Report dated Aug. 13, 2018 for PCT/US2018/030372 filed May 1, 2018.
Written Opinion dated Aug. 13, 2018 for PCT/US2018/030372 filed May 1, 2018.
International Preliminary Report on Patentability dated Oct. 22, 2019 for PCT/US2018/027956.
International Search Report, Written Opinion, International Preliminary Report on Patentability for PCT/US2004/039399 filed Nov. 22, 2004.
International Search Report, Written Opinion, International Preliminary Report on Patentability for PCT/US2005/032661 filed Sep. 14, 2005.
International Search Report, Written Opinion, International Preliminary Report on Patentability for PCT/US2005/043934 filed Dec. 2, 2005.

(56) References Cited

OTHER PUBLICATIONS

International Search Report, Written Opinion, International Preliminary Report on Patentability for PCT/US2015/53138 filed Sep. 30 2015.
International Search Report and Written Opinion for PCT/US2016/32170 filed May 12, 2016.
European Search Report for EP05796234 dated Nov. 5, 2007 (realted to WO2006031853).
International Search Report for PCT/IL01/01078 filed Nov. 22, 2001.
Office Action for U.S. Appl. No. 16/491,321, dated Apr. 21, 2020.
International Preliminary Report on Patentability dated Sep. 10, 2019 with Written Opinion for PCT/US2018/021919, filed Mar. 12, 2018.

* cited by examiner

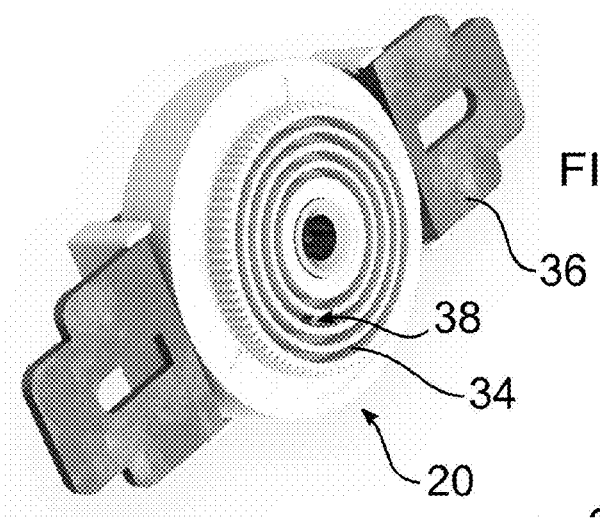
FIG. 1
FIG. 2
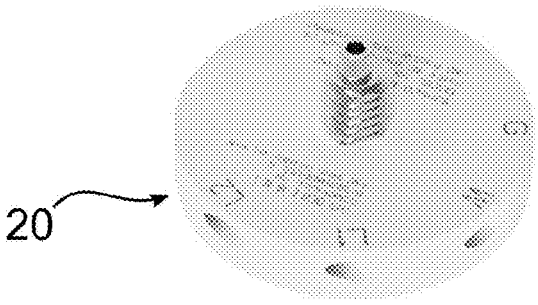
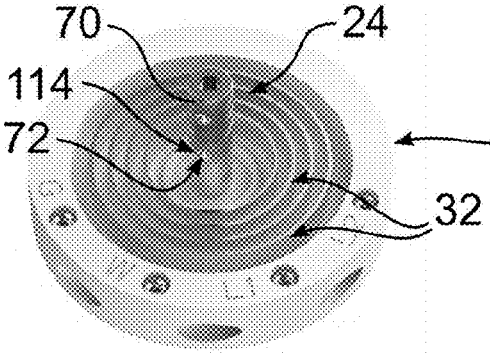
FIG. 3
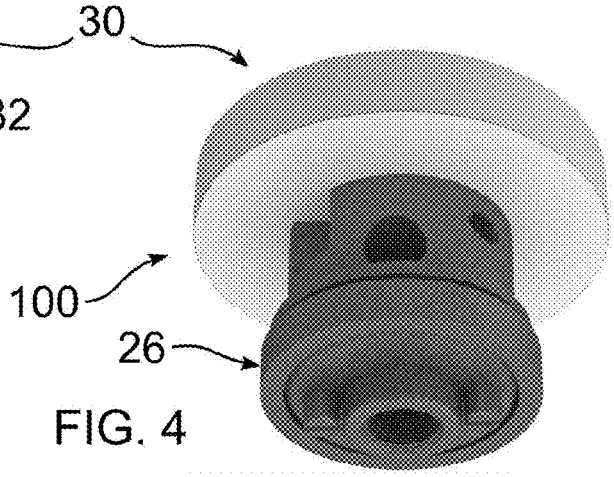
FIG. 4
FIG. 5
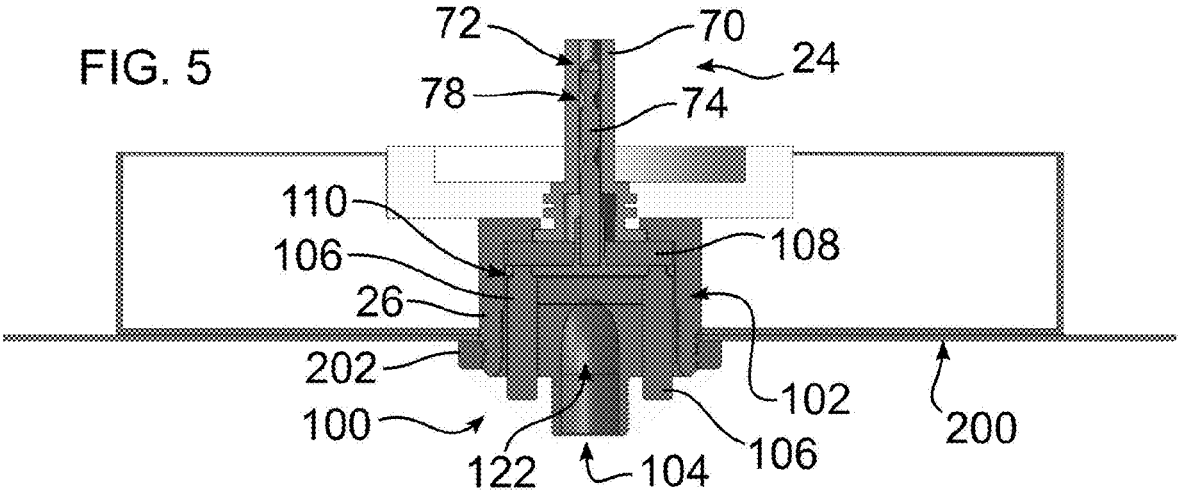

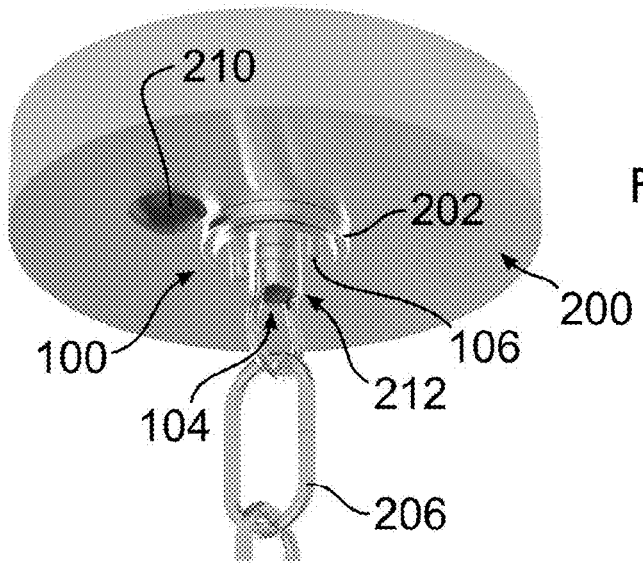
FIG. 6
FIG. 7
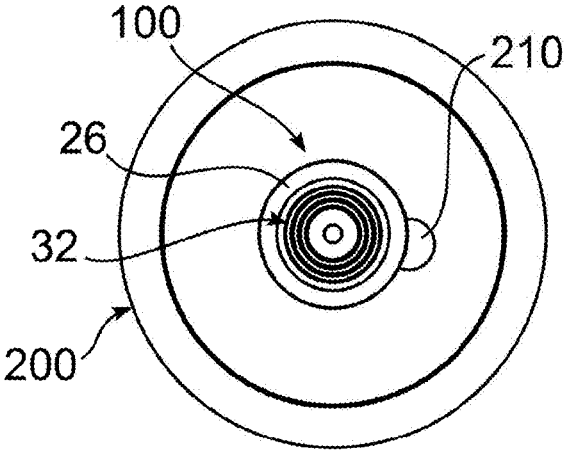
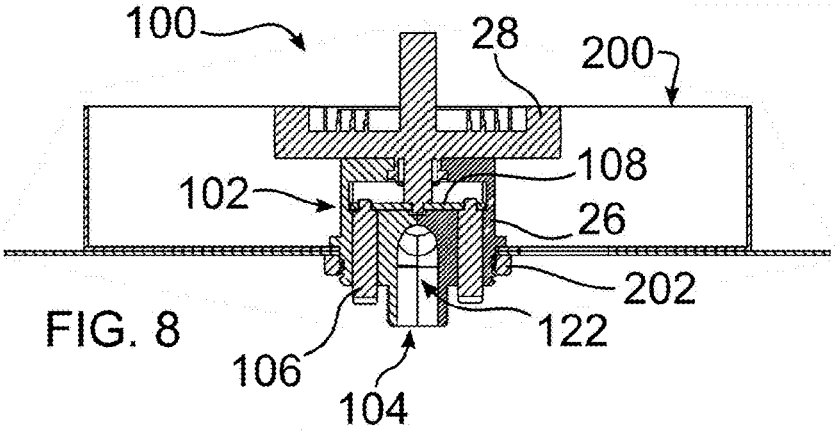
FIG. 8
FIG. 9
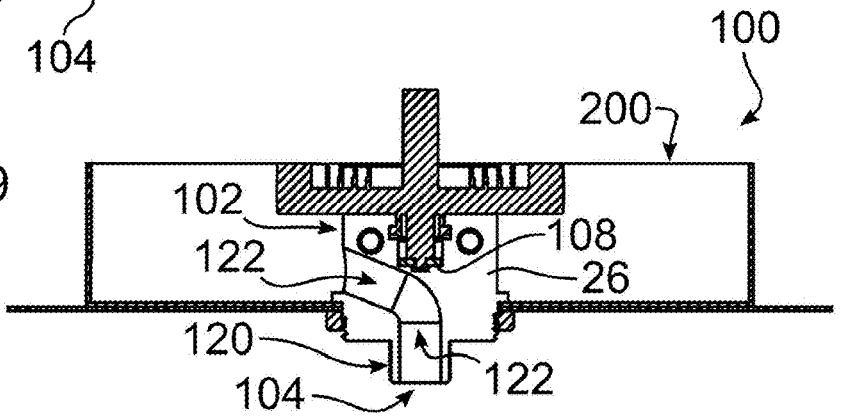

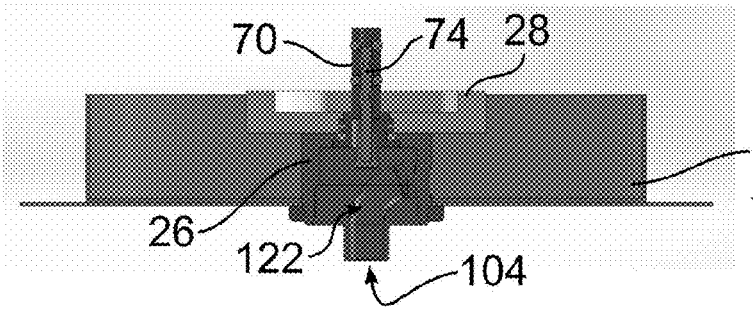
FIG. 10
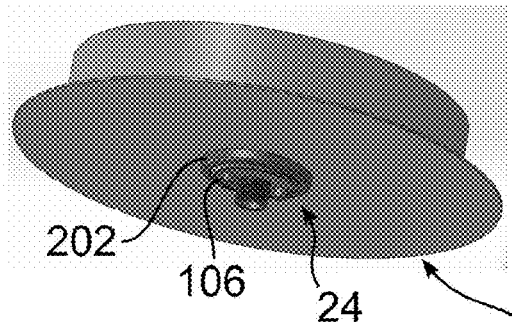
FIG. 11
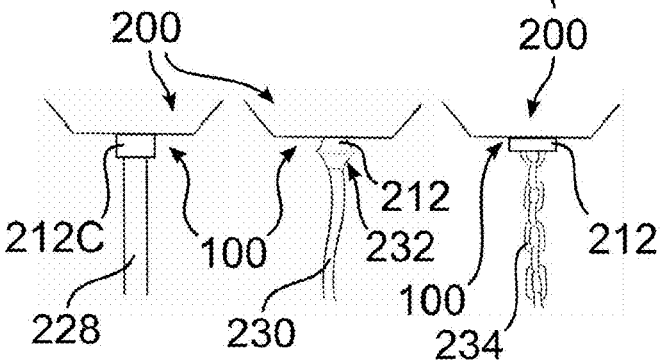
FIG. 12
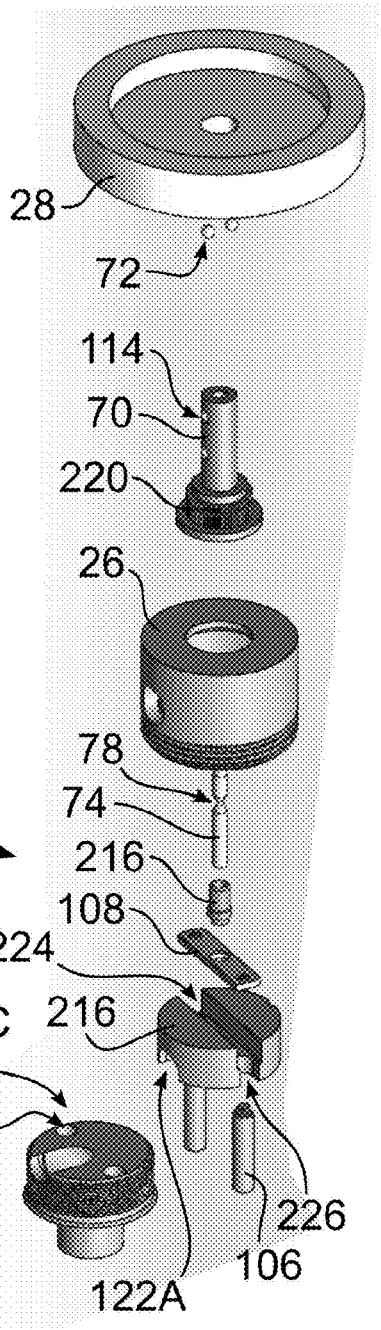
FIG. 13
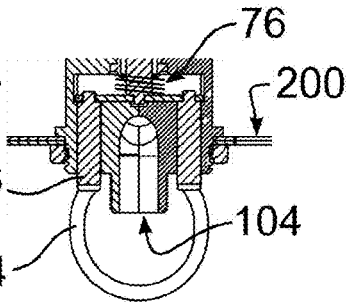
FIG. 14
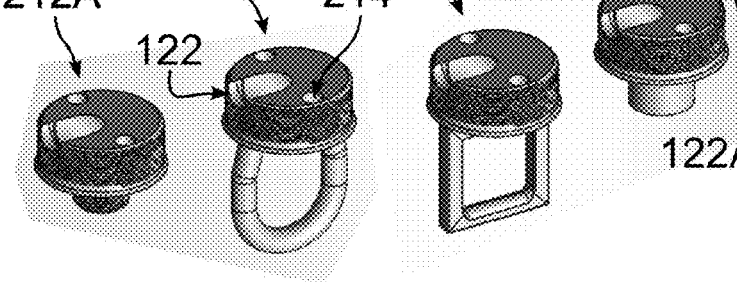

DISCONNECTING AND SUPPORTING QUICK RELEASE ELECTRICAL FIXTURES

CROSS REFERENCE TO RELATED APPLICATIONS

This disclosure relates to PCT International Patent Application No. PCT/US2016/032170 filed May 12, 2016 (published as WO 2016/183354 A1); U.S. Pat. Nos. 7,462,066 filed March 20, 2007; 7,192,303 filed Dec. 2, 2004; and 6,962,498 filed Dec. 12, 2001; and to U.S. Patent Application Publication No. 2009/0280673 filed Dec. 2, 2005; U.S. Provisional Applications 62/160,585 filed May 12, 2015; 62/308,718, filed Mar. 15, 2016; 62/467,176 filed Mar. 5, 2017; and 62,470,170 filed Mar. 10, 2017; the contents of all of which are hereby incorporated by reference herein, in their entirety.

FIELD OF THE DISCLOSURE

The disclosure relates to a system and method for securely connecting suspended electrical fixtures without tools, and in particular, by a connection including a push-button mechanism which does not interfere with centrally mounted fixtures.

BACKGROUND OF THE DISCLOSURE

Traditional techniques for installing electrical fixtures and appliances, such as lighting fixtures and fans on walls or ceilings usually require the assistance of a qualified electrician, and the use of a variety of tools and specialized hardware. The procedure for installing or uninstalling such fixtures can also be relatively time consuming, even when carried out by an experienced installer. In addition to the need for hand-wiring the necessary electrical connections between the fixture and electrical power supply wiring, the installer must make separate mechanical connections for supporting or suspending the fixture in place.

SUMMARY OF THE DISCLOSURE

In an embodiment of the disclosure, a plug useable with an affixed electrical socket having a body forming a plurality of concentric ring shaped openings terminating in electrical contacts, comprises a body; a plurality of electrically conductive concentric rings insertable within the plurality of concentric ring shaped openings of the socket to thereby form electrical connections with the electrical contacts of the socket; a hollow post extending from the body at the center of the concentric rings, the post having an aperture extending therethrough and being transverse to a longitudinal axis of the post; a rod slideably having a portion extending within the hollow post, and an end extending outside the post, the rod including a narrowed portion, the rod slideable between a release position in which the narrowed portion is adjacent the aperture and a latched position in which the narrowed portion is away from the aperture; a spring connected to the rod and the body to bias the rod towards the latched position; an elongate cross-brace connected to the rod end at a rod connection location and having opposed brace ends positioned away from the rod connection location; two elongate pins, each connected to an opposed brace end to extend away from the cross-brace, whereby when the elongate pins are moved, the cross-brace is caused to move, whereby the rod is slideably moved within the post, against the bias of the spring, from the latched position to the release position.

In variations thereof, the pins extend from the body to form button shapes which are pressable by a user of the plug; the device further includes balls positioned within the aperture, whereby when the rod is in the latched position, the balls are pushed within the apertures to extend at least partially beyond an outer circumference of the post, and when the rod is in the release position, the balls are pushable to be positioned entirely within the outer circumference of the post and partially within the narrowed portion of the rod; the device further includes a second aperture positioned away from the aperture and extending through the post and being transverse to a longitudinal axis of the post; and/or the immediately foregoing variation, wherein the second aperture is radially offset 90 degrees from the aperture.

In further variations thereof, the device further includes a base positioned between the rod and the cross-brace; the cross-brace further includes an aperture formed into each of the opposed ends of the cross-brace, each sized to receive a portion of a pin; the body includes a central aperture axially aligned with the rod and forming a pathway dimensioned for passage of an electrical cable when an electrical cable is inserted into the central aperture; and/or the central aperture includes a bend at a location away from the central aperture, the bend sized for passage of the electrical cable, when an electrical cable is inserted through the central aperture and bend.

In additional variations thereof, the post is connected to a body having a round threaded portion, the threaded portion including a flattened side portion; and/or the pins having opposed ends not connected to the cross-brace, the opposed ends mutually connected by a loop, the loop pushable to simultaneously push both pins.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein:

FIG. 1 is a front perspective view of a socket useable together with plug/spindle assemblies of the disclosure;

FIG. 2 is a back perspective view of the socket of FIG. 1;

FIG. 3 is back perspective view of a spindle assembly of the disclosure;

FIG. 4 is front perspective view of a spindle assembly of the disclosure;

FIG. 5 is a central cross-section of the spindle assembly of FIG. 4, together with a mounted canopy;

FIG. 6 is a perspective view of the spindle assembly and canopy of FIG. 5;

FIG. 7 is a back view of the spindle assembly and canopy of FIG. 5;

FIG. 8 is a central cross-section of the spindle assembly and canopy of FIG. 4, illustrating additional elements;

FIG. 9 is a cross-section of the spindle assembly of FIG. 8, rotated 90 degrees;

FIG. 10 is a cross-section of the spindle assembly of FIG. 4;

FIG. 11 is a perspective front view of the spindle assembly of FIG. 4, mounted to a canopy;

FIG. 12 is an exploded view of the spindle assembly of FIG. 4;

FIG. 13 illustrates various fixture attachment methods useable with the spindle assembly of FIG. 4;

FIG. 14 illustrates a cross section of a portion of the spindle assembly of FIG. 4, including a loop affixed to release pins;

DETAILED DESCRIPTION OF THE DISCLOSURE

Figure 15:
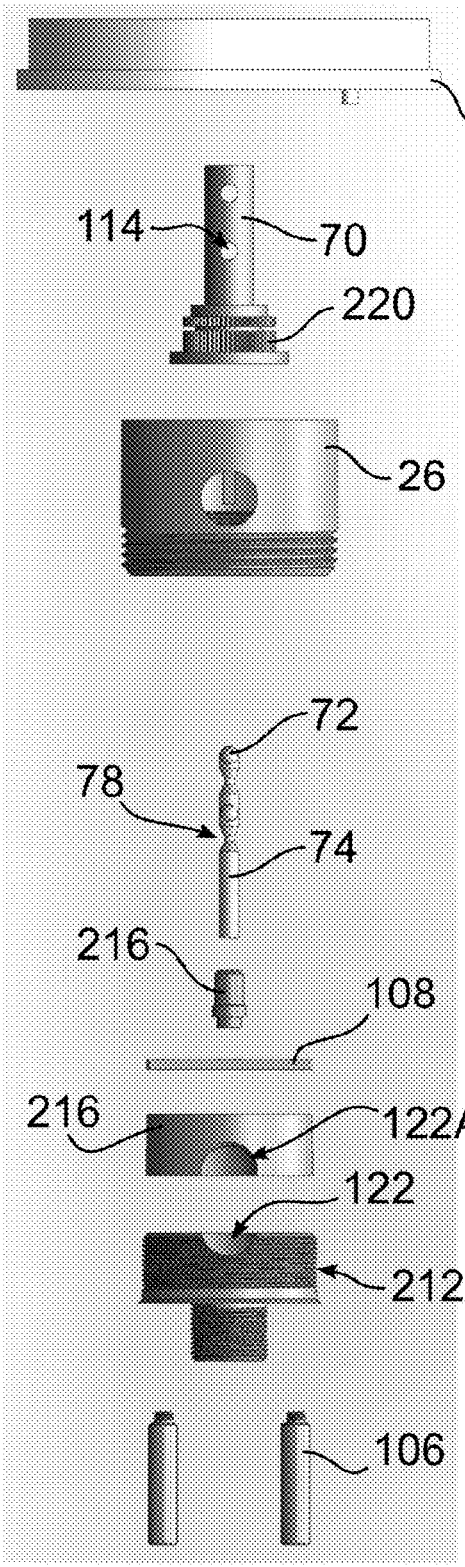
FIG. 15 is an exploded view of the spindle assembly of FIG. 4.
Figure 16:
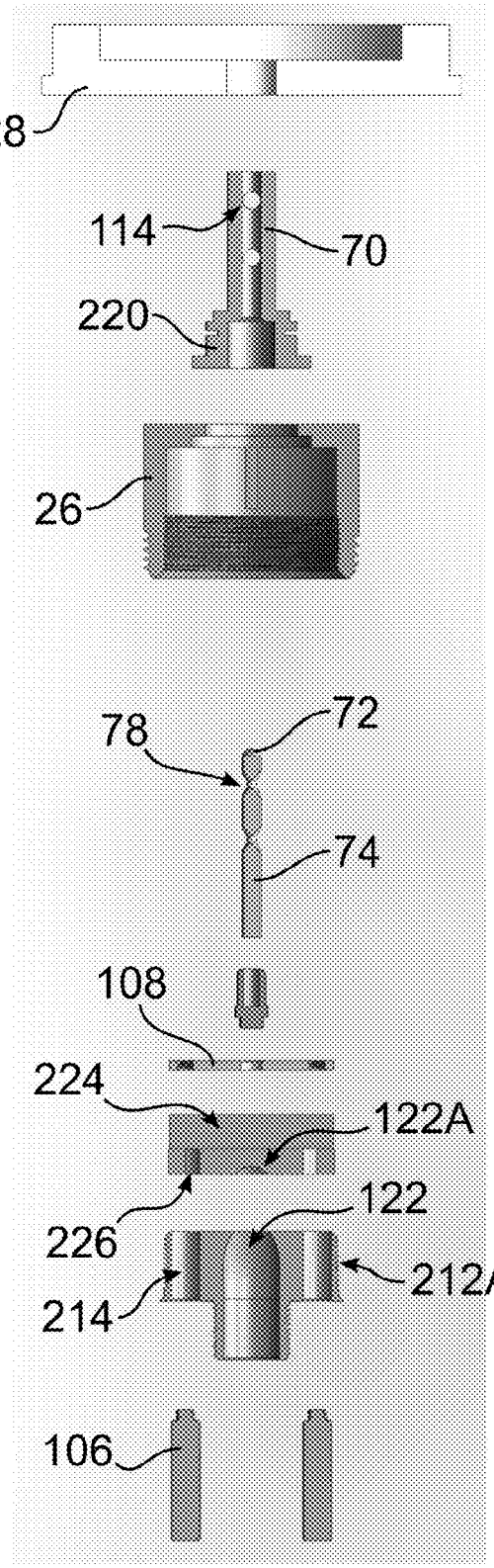
FIG. 16 is a central cross-section through the spindle assembly of FIG. 15.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

Previous disclosures of the inventor, cited above, describe a flexible socket which admits a plug for conducting electric power to a light, fan or other suspended fixture. The plug mechanically supports the weight of the fixture, in a desired orientation, to that the fixture can also receive power from the plug. A central releasable latching mechanism allows partial or total withdrawal of the plug. Partial withdrawal is used to support the weight of the fixture while a change is made to the rotational orientation of the fixture. Total withdrawal is used to transfer the fixture to another location.

A "quick connect device" for installing electrical fixtures comprises the combination of a plug and mating socket. The plug and mating socket of the device function to both establish an electrical connection between an electrical fixture and electrical supply wiring, and mechanically support the fixture on a surface or base, typically a wall, ceiling or floor surface. As used herein, the term "fixture" or "electrical fixture" means any fixture or appliance such as a lighting fixture, ceiling fan, television camera, security device or any other device which is powered by electricity supplied by electrical wiring, and which requires a mechanical connection to support or suspend the fixture. The plug is fixedly secured to an electrical fixture, while the socket is secured to either the surface (e.g., wall, ceiling or floor) on which the fixture is to be mounted, or to an electrical junction box. The structure, function, and operation of the plug and mating socket have already been detailed in, for example, the patents and application incorporated by reference herein, and reference may be had thereto for details regarding the quick release fixture generally, as well as to variations thereof which can all be used in combination with the disclosure.

Referring generally to FIG. 1-5, a socket 20 of a quick connect device for installing electrical fixtures receives a plug 30, thereby forming an electrical connection between socket 20 and plug 30. In FIG. 1, socket 20 is attached to a bracket 36 which is configured for mounting to a standard electrical box. In accordance with the disclosure, a combination device 100 is configured and dimensioned to mate with socket 20. Combination device 100 includes a spindle assembly 24 as described in the incorporated references, which is used to releasably mechanically connect plug 30 to socket 20. Combination device 100 also includes a body 26 having, on a first side, concentric, male connector rings 32, which may be integrally molded into the body 26 if molded from a non-conductive material. Rings 32 have sufficient radial spacing therebetween to electrically insulate them from each other. The diameters and spacing of the male connector rings are such that they are alignable with and receivable within corresponding female recesses 34 in the socket 20, to make contact mating conductors 38 within socket 20. As detailed in the patent publications incorporated by reference, this alignment is used to electrically connect the plug 30 to the socket 20, thereby establishing an electrical connection between an electrical fixture and electrical supply wiring, and mechanically supporting the fixture on a surface or base, typically a wall, ceiling or floor surface.

With reference to FIGS. 4-12, a two-pin release mechanism 102 enables detachment of device 100 while leaving an unobstructed central area 104, through which an electrical cable, support pole, or other object can pass and/or connect to device 100. Pins 106 can be pressed by thumbs while the fingers of each hand grasp body 26, to disconnect spindle assembly from socket 20 and release device 100. In the embodiment shown, device 100 is connected to a canopy 200 by a threaded ring 202. Accordingly, canopy 200 can be grasped by the fingers to support the weight of device 100, canopy 200, and any attached fixture, while both pins 106 are pressed to release device 100.

More particularly, pins 106 slidably extend through body 26 or through a pin aperture 214 within a fixture attachment element 212 (FIG. 12). In the figures, pin 106 forms an elongated shaft, however it should be understood that pin 106 could be implemented as a separate button extending to an exterior of device 100 which is in turn attached to a shaft which passes through aperture 214. A cross-brace 108 connects ends 110 of pins 106 and engages release rod 74.

A spring 76 (shown in FIGS. 14 and 17-18) biases rod 74 to position recesses 78 away from balls 72 to maintain balls 72 trapped within apertures 114 (see FIGS. 12-14) within post 70, thereby preventing withdrawal of post 70 from cylinder 68 of socket 20 due to interference between balls 72 and cylinder 68. When pins 106 are pressed against the bias of spring 76, rod 74 is moved to align recesses 78 with balls 72, thereby allowing balls 72 to move out of interference with cylinder 68, enabling withdrawal of post 70 from cylinder 68, and thereby removal of device 100 from socket 20.

FIG. 6 depicts a swage or pendant light fixture, where a fixture attachment 212 including a chain 206 is affixed to device 100 by a threaded connection formed with an externally threaded end 120 of base 26. A wire conductor, not shown, passes through central area 104 into an interior of canopy 200, where appropriate electrical connections can be made. In this embodiment, canopy 200 includes a sensor 210 of a type selected for detecting a particular desired ambient condition, as detailed in the incorporated references. FIG. 7 depicts the embodiment of FIG. 6, as viewed from the top or installation end. FIGS. 8 and 9 are cross-sections of FIG. 7, taken 90 degrees apart, wherein an internal pathway 122 for a conductor wire can be seen.

In FIG. 12, four alternative fixture attachment elements are shown, including the chain type attachment element 212 of FIG. 6, an externally threaded stud 212A, an internally threaded stud 212C, and a square link 212B, any of which can be threaded into body 26, or affixed to body 26 by any other means. FIG. 12 additionally depicts pin apertures 214 which slideably support pins 206. Post 70 is inserted into a post receiver 216, and receiver 216 is in turn inserted into cross-brace 108. Body 26 forms a fixture attachment receiver for threadably connecting fixture attachment element 212, and supports a canopy 200, if present. A cross-brace guide 222 includes a cross-brace channel 224 which aligns and guides cross-brace 108, and which further includes pin guides 226, and which forms a portion 122A of internal pathway 122. Post 70 includes a post base 220 which engages receiver 218. Post 70 passes through receptacle base 28.

In FIG. 13, three styles of fixture attachment are illustrated. At left, a rod 228 is attached, for example by threading onto or into fixture elements 212A or 212C, respectively. An electrical wire can be passed through rod 228 to a remainder of the fixture. This type of attachment can work for a sconce or floor standing fixture, as well as a suspended fixture. In the center, a flexible electrical cable 230 is connected to a grommet or strain relief 232 which is connected to fixture element 212. At right, a chain 234 extends from fixture element 212. Examples fixture which can thus be attached include pendants, chandeliers, semi-flushmount fixtures, and emergency or exit signs.

FIG. 14 illustrates one embodiment in which a first link 234 of a chain is connected at each opposite end to a pin 106, whereby a connected fixture can be released by pushing up on first link 234, and while pushing up, separating the fixture from socket 20.

Device 100 including plug 30 provides an instant plug-and-play platform for light fixtures and ceiling fans. Device 100 can be integrated into lighting or other electrical fixtures during the manufacturing process. Device 100 includes two push-buttons (pins 106) that are pushed to enable locking a fixture in place while simultaneously forming electrical contacts to provide the fixture with power. Pins 106 can be pushed again to enable releasing of the fixture while safely disconnecting the electrical connections. By providing two pins 106 which flank a centrally disposed opening 104, many fixtures which require or benefit from a central mounting point and electrical connection can be easily connected and disconnected.

As such, consumers can safely install and replace electrical fixtures with a simple push and click. Socket 20 is installed into a standard lighting junction box and provides both power and mechanical support to any fixture equipped with device 100. Socket 20 is installed by inserting electrical wires of the facility into wire traps, and then further securing the wires with screw clamps. Where socket 20 is provided with an appropriate bracket, the bracket is then secured into the junction box with two screws. A simple and attractive cover plate is connected to socket 20 to cover any wall box and unfinished surfaces, completing the final installation and providing a tidy appearance. The receptacle thus configured is safe to touch, even when the power is on, and avoids a risk of electrical shock.

Referring now to FIGS. 17-21, an alternative spindle assembly 24A which can be incorporated into device 100 in place of spindle 24, and which can be substituted for other spindle assemblies in the incorporated references. Spindle assembly 24A includes a post 70A formed with at least two apertures 114, 114A for passage of balls 72, however at least two of the apertures 114, 114A are radially offset 90 degrees with respect to each other. In this manner, by offsetting apertures 114, 114A, the likelihood of a failure along the longitudinal linear axis of rod 74 or post 70A is reduced, as there are fewer bore holes along a particular linear axis. Additionally, any axially extending defect in post 70A or rod 74 which causes a failure of one of aperture 114 or 114A does not necessarily result in a mechanical failure of spindle assembly 24A which might otherwise result in an inability of spindle assembly 24A to continue to support an attached fixture. Further, apertures 114 and 114A continue to cooperate to provide a cumulatively greater pull-out strength of spindle assembly 24A.

Figure 18:
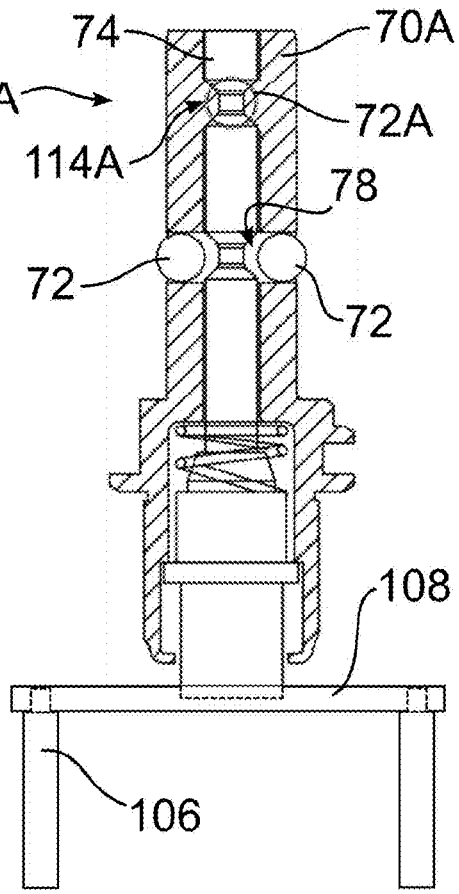
FIG. 18 depicts the spindle assembly of FIG. 17 in a release position, and further illustrates a combination with a dual release pin configuration of the disclosure.

In FIG. 18, cross-brace 108 and pins 106 are shown, to clarify that spindle assembly 24A can be used in other embodiments of the disclosure.

Figure 17:
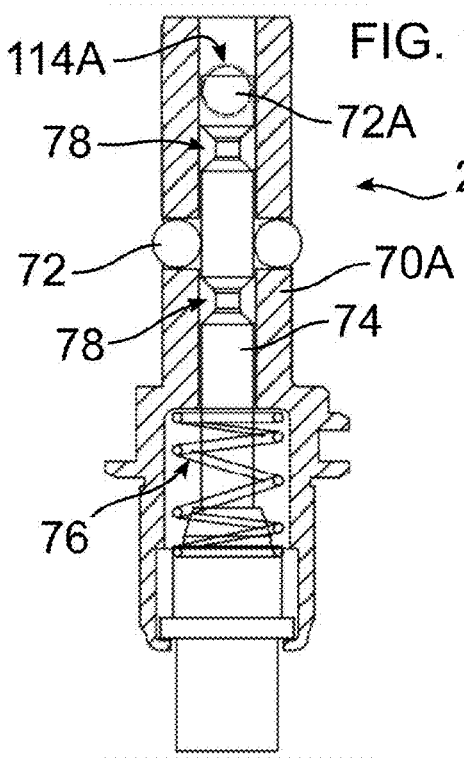
FIG. 17 is a central cross-section through an alternative spindle assembly of the disclosure, including apertures and captive balls offset 90 degrees.
Figure 19:
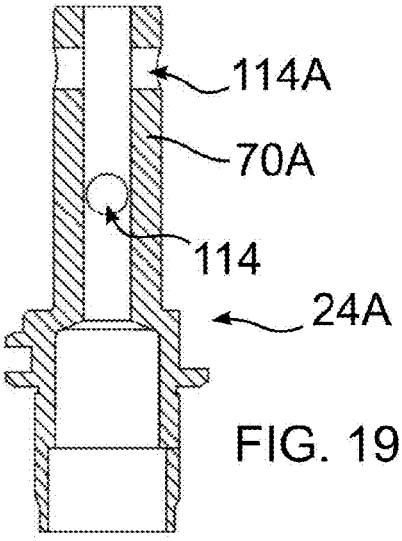
FIG. 19 is a central cross-section of a post component of the spindle assembly of FIG. 17.
Figure 20:
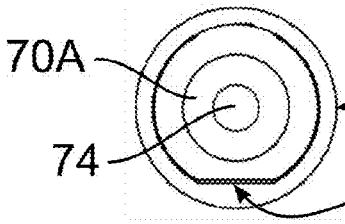
FIG. 20 is a side view of the spindle assembly of FIG. 17.
Figure 21:
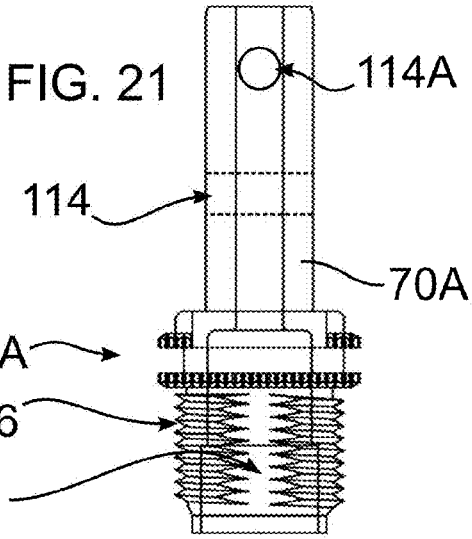
FIG. 21 is a bottom end view of the spindle assembly of FIG. 17.

FIG. 19 illustrates a bisecting cross-section of FIG. 17, with rod 74 removed. FIGS. 20 and 21 depict spindle assembly 24A removed from device 100. A flattened profile 128 is provided upon a round portion of base 126, which can be threaded, the flat portion mateable to a corresponding flattened area provided upon a mounting point for spindle assembly 24A, such as a fixture, canopy, or mounting bracket to which spindle assembly 24A is to be mounted, thereby keying spindle 24A to a particular radial orientation with respect to the fixture or mounting point.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

What is claimed is:

1. A plug useable with an affixed electrical socket having a body forming a plurality of concentric ring shaped openings terminating in electrical contacts, the plug comprising:

a body;

a plurality of electrically conductive concentric rings insertable within the plurality of concentric ring shaped openings of the socket to thereby form electrical connections with the electrical contacts of the socket;

a hollow post extending from the body at the center of the concentric rings, the post having an aperture extending therethrough and being transverse to a longitudinal axis of the post;

a rod slideably having a portion extending within the hollow post, and an end extending outside the post, the rod including a narrowed portion, the rod slideable between a release position in which the narrowed portion is adjacent the aperture and a latched position in which the narrowed portion is away from the aperture;

a spring connected to the rod and the body to bias the rod towards the latched position;

an elongate cross-brace connected to the rod end at a rod connection location and having opposed brace ends positioned away from the rod connection location;

two elongate pins, each connected to an opposed brace end to extend away from the cross-brace, whereby when the elongate pins are moved, the cross-brace is caused to move, whereby the rod is slideably moved within the post, against the bias of the spring, from the latched position to the release position.

2. The plug of claim 1, wherein the pins extend from the body to form button shapes which are pressable by a user of the plug.

3. The plug of claim 1, further including balls positioned within the aperture, whereby when the rod is in the latched position, the balls are pushed within the apertures to extend at least partially beyond an outer circumference of the post, and when the rod is in the release position, the balls are pushable to be positioned entirely within the outer circumference of the post and partially within the narrowed portion of the rod.

4. The plug of claim 1, further including a base positioned between the rod and the cross-brace.

5. The plug of claim 1, the cross-brace further including an aperture formed into each of the opposed ends of the cross-brace, each sized to receive a portion of a pin.

6. The plug of claim 1, the post connected to a body having a round threaded portion, the threaded portion including a flattened side portion.

7. The plug of claim 1, the pins having opposed ends not connected to the cross-brace, the opposed ends mutually connected by a loop, the loop pushable to simultaneously push both pins.

8. The plug of claim 1, further including a second aperture positioned away from the aperture and extending through the post and being transverse to a longitudinal axis of the post.

9. The plug of claim 8, wherein the second aperture is radially offset 90 degrees from the aperture.

10. The plug of claim 1, the body including a central aperture axially aligned with the rod and forming a pathway dimensioned for passage of an electrical cable when an electrical cable is inserted into the central aperture.

11. The plug of claim 10, wherein the central aperture includes a bend at a location away from the central aperture, the bend sized for passage of the electrical cable, when an electrical cable is inserted through the central aperture and bend.

* * * * *